United States Patent [19]

Burk et al.

[11] Patent Number: 4,470,385

[45] Date of Patent: Sep. 11, 1984

[54] IGNITION DISTRIBUTOR

[75] Inventors: John F. Burk; Terry A. Spidel, both of Anderson, Ind.

[73] Assignee: General Motors Corporation, Detroit, Mich.

[21] Appl. No.: 419,829

[22] Filed: Sep. 20, 1982

[51] Int. Cl.[3] ..... F02D 7/02

[52] U.S. Cl. ..... 123/146.5 B; 200/19 R

[58] Field of Search ..... 123/146.5 A, 146.5 B, 123/198 B; 200/19 R

[56] References Cited

U.S. PATENT DOCUMENTS 1,557,226 10/1925 Wilson .

3,358,482 12/1967 Parr ..... 123/198 B X 3,861,225 1/1975 Mattson ..... 123/146.5 A X 4,383,505 5/1983 Hanaoka et al. ..... 123/146.5 A

*Primary Examiner*—Tony M. Argenbright

*Attorney, Agent, or Firm*—C. R. Meland

[57] ABSTRACT

An ignition distributor for an internal combustion engine in which the rotor is locked in a predetermined position by a locking pin fixed to the base of the distributor and having a portion thereof positioned in a slot formed in a plate that rotates with the distributor shaft and rotor. The rotor is locked in a position in which the electrode or segment thereof faces or is aligned with one of the output terminals of the distributor cap and when the distributor shaft is driven by the engine the locking pin breaks or fractures to permit free rotation of the rotor.

3 Claims, 4 Drawing Figures

IGNITION DISTRIBUTOR

This invention relates to ignition distributors for internal combustion engines and more particularly to an ignition distributor where the rotor is temporarily locked in a fixed rotative position relative to a terminal of a distributor cap by means that can be broken to unlock the rotor when the distributor shaft is initially driven by the engine.

When an ignition distributor is assembled to an internal combustion engine the distributor drive shaft is mechanically connected to the engine camshaft and the distributor base with the attached distributor cap is rotated to a proper position relative to the rotor in order to provide proper ignition timing for the engine. Thus, the conventional procedure is to assemble the ignition distributor to the engine with the gear that drives the distributor shaft meshing with a gear driven by the camshaft. This meshing fixes the distributor drive shaft and the rotor carried thereby from rotation and the distributor base and attached distributor cap can then be rotated relative to the drive shaft and rotor such that the electrode or segment of the rotor is in alignment with one of the output terminals of the distributor cap to provide proper ignition timing.

In contrast to the procedure that has just been described it is an object of this invention to provide an ignition distributor which can be assembled to the engine and after assembly provides proper ignition timing without rotative adjustment of the base and cap relative to the rotor. In carrying this object forward a breakable device is disposed between the base of the distributor and the rotor such that it temporarily locks the rotor and drive shaft of the distributor from rotation relative to the base and cap. The locked rotative position of the rotor is such that the electrode or segment of the rotor is aligned with one of the output terminals of the distributor cap, for example the terminal that is connected to the spark plug that fires the number one cylinder of the engine. Assuming the engine piston of the number one cylinder has been positioned at substantially top dead center in its power stroke the distributor can now be assembled to the engine with the drive gear of the distributor shaft meshing with the camshaft gear of the engine. When the distributor has been assembled to the engine proper ignition timing is provided since the rotor electrode is aligned with the proper cap output terminal and no adjustment of the distributor base and attached cap is required. When the engine is now cranked or otherwise rotated the distributor shaft is driven by the engine which causes the breakable device to break permitting free rotation of the distributor shaft and rotor.

A more specific object of this invention is to provide an ignition distributor in which the device that temporarily locks the rotor in place comprises a breakable pin having one end portion secured to the distributor base and its opposite end portion projecting through an opening formed in a plate that is rigidly secured to the distributor shaft. The distributor rotor is likewise fixed to the distributor shaft so that the pin thereby locks both the distributor shaft and rotor in a proper position. The locking pin has a portion that breaks or fractures when the distributor shaft is rotated to permit free rotation of the distributor shaft and rotor.

IN THE DRAWINGS

Figure 1:
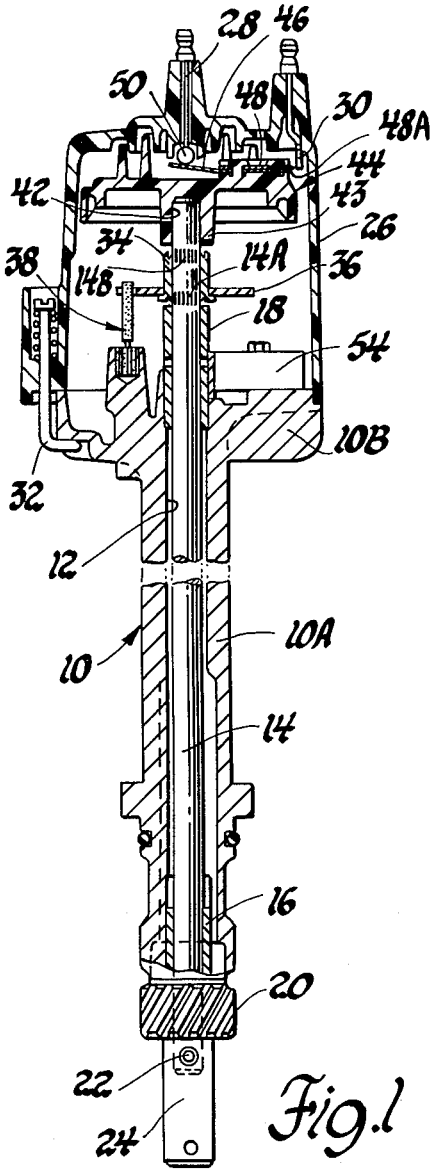
FIG. 1 is a sectional view of an ignition distributor made in accordance with this invention.

Referring now to the drawings and more particularly to FIG. 1, the reference numeral 10 generally designates the base of an ignition distributor which is formed of metallic material. The base 10 has a portion 10A that has a central bore 12 that receives a distributor shaft 14 journaled for rotation in bearings 16 and 18 that are supported by the base. The shaft 14 carries a helical gear 20 which is pinned thereto by a pin 22 in a conventional manner. The gear 20 is attached to part 24 having a hexagonal bore (not illustrated) that receives the drive shaft of an engine oil pump in a manner well known to those skilled in the art.

The base 10 has an annular portion 10B which supports a distributor cap 26 formed of insulating material. The distributor cap has a center electrode or terminal 28 which is connected to the secondary of an ignition coil. The distributor cap has a plurality of circumferentially spaced output electrodes or terminals 30, only one of which is illustrated in the drawing, which are connected respectively to the spark plugs of the engine.

The distributor cap 26 is attached to the base 10 in a conventional manner by a plurality of spring biased latch hooks 32 only one of which is illustrated in the drawing and the cap has a lug or tab (not illustrated) that fits into a complementary notch (not illustrated) formed in base portion 10B in a manner well known to those skilled in the art. This prevents rotation of the cap relative to the base and allows the cap to be assembled to the base in only one relative rotative position.

The shaft 14 has splined sections 14A and 14B for securing a metal bushing 34 to the shaft. The bushing 34 is nonrotatably secured to the shaft by staking the bushing into the splined sections. The bushing 34 carries a plate 36 formed of metallic material which is staked or otherwise secured to bushing 34. The plate 36 has an open ended slot or opening 36A which receives the end of a breakable locking pin generally designated by reference numeral 38.

Figure 3:
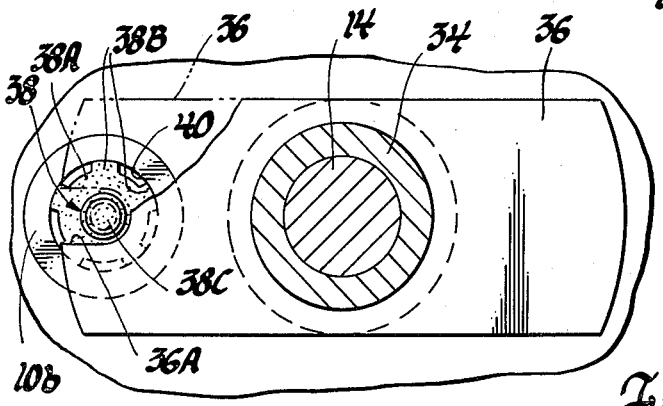
FIG. 3 is a view taken along line 3—3 of FIG. 2.

The pin 38 is formed of plastic material such as a glass filled nylon and has a portion 38A press fitted into an annular bore 40 formed in the base portion 10B. The portion 38A has outer circumferentially spaced ribs 38B engaging the wall defining the bore 40 as shown in FIG. 3. The pin 38 has an annular portion 38C, the end of which projects through the opening 36A, formed in the plate 36. The pin 38 has a reduced diameter portion 38D to provide an area that breaks or fractures in a manner to be more fully described hereinafter.

The upper end of the distributor shaft 14 is located in a bore 42 formed in hub portion 43 of a rotr 44 that is formed of insulating material. The bore 42 contains an integral lug (not illustrated) that fits into a slot (not illustrated) formed in the end of shaft 14 to connect the rotor to the shaft 14. The type of connection just described is shown in U.S. Pat. No. 2,828,374 to Redick. The rotor 44 carries conductive means comprised of a conventional contact spring 46 and a segment or electrode 48. These two parts overlap and engage each other and are held fixed to the rotor 44 by peening over portions of the rotor. The end 48A of electrode 48 swings past the ends of output terminals 30 when the rotor is rotated. The spring contact 46 engages a ball contact 50 which is in electrical contact with the input terminal or electrode 28.

In the assembly of the ignition distributor of this invention the shaft 14 and the attached plate 36 and rotor 44 are assembled to the base 10 by sliding the shaft 14 axially into the bearings 16 and 18 and this is done prior to assembling the gear 20 to the shaft. During this assembly procedure the shaft 14 is so rotatably oriented that the end of portion 38C of the breakable pin or post 38 slips through the opening 36A of the plate 36. The shaft 14 and rotor 44 are now locked or prevented from being rotated relative to the base 10 and the cap 26. The parts of the distributor are so oriented relative to each other that the end 48A of the segment or electrode 48 of the distributor rotor is aligned with one of the output terminal cap electrodes or terminals. The particular distributor cap terminal that is aligned with the rotor electrode corresponds to a certain engine cylinder, for example the number one cylinder. In regard to the foregoing and as previously pointed out, the distributor cap 26 is provided with a tab or lub fitting into a slot in the distributor base portion 10B such that the distributor cap 26 can be assembled to the base 10 in only one rotative position.

When the distributor is completely assembled, as shown in FIG. 1, with the end of portion 38C of pin 38 extending through opening 36A in plate 36 the distributor can be assembled to the engine. Prior to assembly the crankshaft of the engine is moved to a position such that, for example, the piston of the number one cylinder will be located at substantially its top dead center position on its power stroke. The distributor assembly is now assembled to the engine and the base if held in a fixed position by a suitable clamping means known to those skilled in the art. The ignition system is now properly timed since the electrode 48 is pointing to the proper ignition cap output terminal and is held or locked in this fixed position during the assembly of the distributor to the engine. When the engine is now cranked or otherwise rotated the reduced portion 38D of the locking pin 38 breaks away due to rotation of the shaft 14 and plate 36 and the shaft and rotor are now free to rotate to distribute spark impulses sequentially to the terminals 30. In this regard, since the locking pin is formed of nylon which is a relatively stiff or brittle material, when the shaft 14 is driven by the engine the portion 38C breaks off at reduced diameter portion 38D and drops down into the portion 10B of the base 10.

Figure 2:
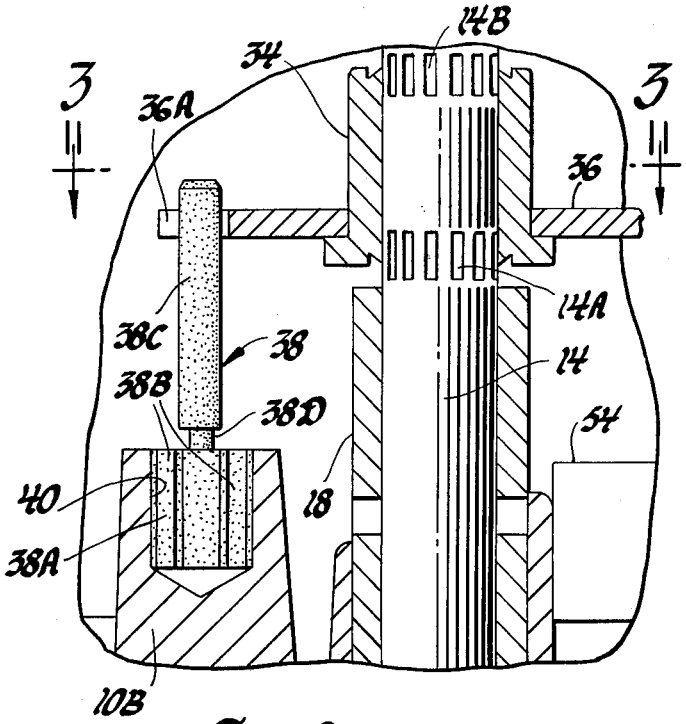
FIG. 2 is an enlarged sectional view of a portion of the distributor shown in FIG. 1.
Figure 4:
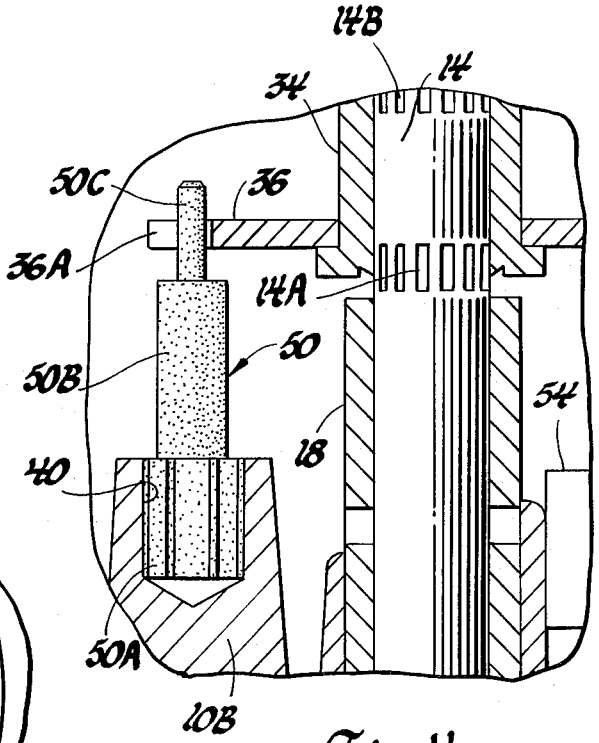
FIG. 4 is a view similar to FIG. 2 which illustrates a modified locking pin.

Referring now to FIG. 4, a modified locking pin is illustrated which performs the same function as pin 38 of FIGS. 1 and 2. The locking pin in FIG. 4 is generally designated by reference numeral 50 and has a ribbed portion 50A press fitted into the bore 40 of the base portion 10B. The pin 50 has an annular portion 50B and a reduced diameter portion 50C which is also annular or cylindrical. In the use of the pin shown in FIG. 4 the end of portion 50C projects through the opening 36A in plate 36. When the distributor shaft is now driven by the engine the portion 52C breaks away and drops down into portion 10B of base 10.

By way of example, the diameter of reduced portion 38D of pin 38 may be approximately 1.8 millimeters. The diameter of portion 50C of pin 50 may be approximately 2 millimeters.

The base 10 of the distributor may carry an electronic module 54 for controlling the ignition system.

The distributor that has been described does not include magnetic pick-up or breaker contacts for controlling primary winding current. Its function is to distribute spark firing impulses sequentially to the spark plugs of the engine via the conductive means of rotor 44, center cap terminal 28 and cap output terminals 30.

The embodiments of the invention in which an exclusive property or privilege is claimed are defined as follows:

1. An ignition distributor for an internal combustion engine comprising, a base member, a shaft rotatable with respect to the base member adapted to be driven by an engine, a distributor cap secured to said base member having an input terminal and a plurality of spaced output terminals adapted to be connected respectively to a spark plug, a rotor fixed to said shaft so as to be rotatably driven thereby carrying conductive means electronically connected to said cap input terminal and having a portion that is rotated past said output terminals when said rotor is rotated, and breakable means interposed between said base member and said rotor for holding the rotor from movement relative to said base member and cap and in a position in which said portion of said conductive means is substantially aligned with one of said cap output terminals, said breakable means being broken to permit free rotation of the rotor when the engine is operated to drive said shaft.

2. An ignition distributor for an internal combustion engine comprising, a base, a distributor shaft rotatable with respect to said base, a distributor cap having an input terminal and a plurality of output terminals attached to said base, a rotor secured to said shaft to rotate therewith having conductive means electrically connected to said input terminal and means rotatable past said cap output terminals, a plate member secured to said shaft to rotate therewith having a slot and a locking pin connected to said base member having a portion thereof positioned in said slot to lock the shaft and rotor from rotation relative to the base and distributor cap, said locking pin being so constructed and arranged as to break away to permit free rotation of the shaft and rotor when the shaft is initially driven by an engine.

3. An ignition distributor for an internal combustion engine comprising, a base member, a shaft journaled for rotation in said base member carrying a rotor which is driven thereby, a distributor cap secured to said base member having an input termnial and a plurality of circumferentially spaced output terminals, said rotor carrying conductive means electrically connected to said input termnial and having a portion thereof moving past said cap output terminals when said rotor is rotated, a plate member secured to said shaft for rotation therewith having a radially extending slot, and a locking pin one end of which is press-fitted into a bore formed in said base for securing the pin to the base, the opposite end of said locking pin being positioned within said slot whereby the distributor shaft and rotor are locked from rotation relative to the cap and base, said locking pin being formed of a breakable material which breaks when said distributor shaft is driven by an engine to thereby permit free rotation of said shaft and rotor.

* * * * *

REEXAMINATION CERTIFICATE (446th)

United States Patent [19]

Burk et al.

[11] B1 4,470,385

[45] Certificate Issued Jan. 21, 1986

[54] IGNITION DISTRIBUTOR

[75] Inventors: John F. Burk; Terry A. Spidel, both of Anderson, Ind.

[73] Assignee: General Motors Corporation, Detroit, Mich.

Reexamination Request:
No. 90/000,727, Feb. 25, 1985

Reexamination Certificate for:

| | |
|---|---|
| Patent No.: | **4,470,385** |
| Issued: | **Sep. 11, 1984** |
| Appl. No.: | **419,829** |
| Filed: | **Sep. 20, 1982** |

[51] Int. Cl.[4] ..... F02D 7/02
[52] U.S. Cl. ..... 123/146.5 B; 200/19 R
[58] Field of Search ..... 123/146.5 A, 146.5 B, 123/198 B; 200/19 R

[56] References Cited

U.S. PATENT DOCUMENTS

| | | | |
|---|---|---|---|
| 1,372,065 | 3/1921 | Conklin . | |
| 1,557,226 | 10/1925 | Wilson . | |
| 2,864,967 | 12/1958 | Redick et al. . | |
| 3,358,482 | 12/1967 | Parr | 123/198 |
| 3,861,225 | 1/1975 | Mattson | 123/146.5 A |
| 3,933,138 | 1/1976 | Stellwagen | 123/146.5 R |
| 4,182,940 | 1/1980 | Scussel et al. | 200/19 R |
| 4,383,505 | 5/1983 | Hanaoka et al. | 123/146.5 A |

FOREIGN PATENT DOCUMENTS

| | | |
|---|---|---|
| 2211986 | 7/1974 | France . |
| 2486592 | 1/1982 | France . |

*Primary Examiner*—Tony M. Argenbright

[57] ABSTRACT

An ignition distributor for an internal combustion engine in which the rotor is locked in a predetermined position by a locking pin fixed to the base of the distributor and having a portion thereof positioned in a slot formed in a plate that rotates with the distributor shaft and rotor. The rotor is locked in a position in which the electrode or segment thereof faces or is aligned with one of the output terminals of the distributor cap and when the distributor shaft is driven by the engine the locking pin breaks or fractures to permit free rotation of the rotor.

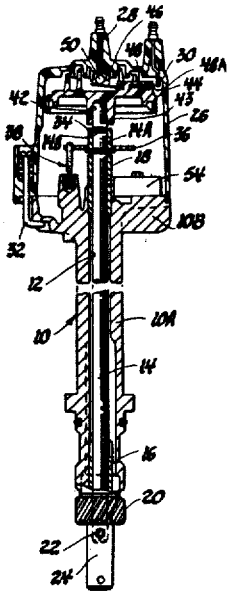

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 3 is confirmed.

Claims 1 and 2 are cancelled.

New claim 4 is added and determined to be patentable.

*4. An ignition distributor for an internal combustion engine comprising, a base member, a shaft journaled for rotation in said base member carrying a rotor which is driven thereby, a distributor cap secured to said base member having an input terminal and a plurality of circumferentially spaced output terminals, said rotor carrying conductive means electrically connected to said input terminal and having a portion thereof moving past said cap output terminals when said rotor is rotated, a plate member secured to said shaft for rotation therewith having a radially extending slot, a bore formed in an internal wall of said base member, and a locking pin one end of which is press-fitted into said bore for securing one said end of said pin to said base member, said locking pin extending toward the interior of said cap with a portion of the opposite end thereof being positioned within said slot when said shaft and attached plate member are assembled to said base member whereby the distributor shaft and rotor are locked from rotation relative to the cap and base member, said slot, said rotor and cap being so oriented that said conductive means of said rotor is substantially aligned with an output terminal of said cap when said pin is positioned in said slot, said locking pin being formed of a breakable material which breaks when said distributor shaft is driven by an engine to thereby permit free rotation of said shaft and rotor.*

* * * * *